United States Patent [19]

Bulatovic

[11] Patent Number: 4,735,783

[45] Date of Patent: Apr. 5, 1988

[54] PROCESS FOR INCREASING THE SELECTIVITY OF MINERAL FLOTATION

[75] Inventor: Srdjan Bulatovic, Peterborough, Canada

[73] Assignee: Falconbridge Limited, Toronto, Canada

[21] Appl. No.: 41,272

[22] Filed: Apr. 22, 1987

[51] Int. Cl.[4] ..... B03D 1/02

[52] U.S. Cl. ..... 423/26; 423/36; 423/45; 75/2; 252/61; 209/901

[58] Field of Search ..... 423/26, 57, 52, 36, 423/45; 75/2; 252/61; 209/901

[56] References Cited

U.S. PATENT DOCUMENTS 3,728,430 4/1973 Clitheroe et al. ..... 423/26
4,098,687 7/1978 Yang ..... 209/166
4,132,635 1/1979 Yang ..... 209/166
4,549,959 10/1985 Armstrong et al. ..... 75/2
4,579,651 4/1986 Bresson et al. ..... 252/61

*Primary Examiner*—Patrick P. Garvin
*Assistant Examiner*—Paige C. Harvey
*Attorney, Agent, or Firm*—Rogers, Bereskin & Parr

[57] ABSTRACT

An aqueous solution containing a water soluble polyvalent metal sulphate, an alkali metal silicate and an alkali metal metabisulphite is described which is added to a slurry of a copper mineral bearing ore to be subjected to a froth flotation step for obtaining a copper concentrate. The aqueous solution is added to enhance the selectivity of conventional flotation collectors and depressants when the valuable minerals are finally disseminated in the host ore, which is then required to be ground to very small particle sizes to achieve the desired liberation. Other valuable minerals such as those bearing zinc and lead, may be recovered from the tailing.

11 Claims, No Drawings

PROCESS FOR INCREASING THE SELECTIVITY OF MINERAL FLOTATION

This invention relates to separation of minerals by an ore beneficiation process.

BACKGROUND OF THE INVENTION

It is well known to separate value metal containing minerals which are disseminated in an ore by an ore beneficiation process, including a froth flotation process step. Valuable minerals are those containing such non-ferrous and precious metals as zinc, lead, copper, nickel, silver and gold. The valuable minerals are often intimately mixed with an iron containing host mineral and it is desirable that as much iron is separated with the gangue minerals as is economically feasible, to reduce the cost of extracting the value metals from the valuable mineral concentrates obtained in the ore beneficiation process. In cases when the dissemination of the valuable minerals in the host ore is fine it is a usual requirement that the ore be ground very finely to achieve suitable liberation. The very fine grind however, often creates more complex surface activity conditions and the effectiveness of well known froth flotation reagents is thus diminished. In such circumstances the conventional depressant and collectors are less selective.

The detrimental effects of a fine grind is especially noticeable when separating copper minerals disseminated in host minerals containing pyrite and pyrrhotite, by the application of conventional modifiers, depressants and collectors. The disseminated copper bearing ore often contains zinc and lead as well and the separation of these elements is also desirable in the same beneficiation process. Thus there is a need to enhance the separation of copper, zinc and lead present in finely disseminated sulphidic ores by conventional flotation processes.

SUMMARY OF INVENTION

A method has now been found for enhancing the selectivity of a flotation separation reagent used in an ore beneficiation process for obtaining a mineral concentrate, by the addition of a premixed aqueous solution of a selectivity enhancing reagent to the aqueous slurry of a copper mineral bearing ore. The premixed aqueous solution contains a water soluble polyvalent metal sulphate, an alkali metal silicate and an alkali metal bisulphite. The premixed aqueous solution may be added to any process step of the ore beneficiation process preceding the separation of the copper mineral containing concentrate.

It has been found that the premixed aqueous solution of this invention is most effective when it is prepared by first mixing the polyvalent metal sulphate in an aqueous solution of an alkali metal silicate, followed by adding with stirring an alkali metal bisulphite to the aqueous solution.

The conventional ore beneficiation process usually includes a grinding step, which may be wet or dry, followed by a conditioning treatment. The conditioning treatment may have several stages. In conditioning the pH of the aqueous ore slurry may be adjusted and other appropriate modifiers are added, to render the surface of the ground ore particles capable of receiving or reacting in some manner with a conventional collector and/or depressant which are added to obtain a concentrate slurry containing the valuable minerals. Froth flotation separation requires the presence of a frother as well. The conventional froth flotation treatment is conducted in several stages to obtain intermediate rougher concentrates and tailings, and to produce a final cleaner concentrate or concentrates of the mineral to be separated. The tailing obtained in the final stage of the flotation may be treated to recover other valuable minerals which have been depressed in the flotation stages.

It has been found that the selectivity enhancing reagent may be equally effective when it is added to the wet grinding or to the conditioning stages as a premixed solution.

DETAILED DESCRIPTION OF THE INVENTION

The preferred embodiment of the invention will now be described and illustrated by working examples.

In the preferred embodiment the flotation separation of copper contained in massive sulphidic ores is enhanced by the addition of a selectivity assisting agent prepared according to the present invention. The massive sulphidic ore containing copper may also contain zinc and lead and some amounts of silver and gold. The finely disseminated ore is usually ground to a particle size which is less than 30 μm to provide suitable liberation of the value metal minerals. The massive sulphidic ores in which these minerals are disseminated contain substantial quantities of pyrite and pyrrhotite and other gangue minerals.

In the preferred composition the selectivity enhancing agent is prepared through the mixing of the chemical compounds:

| | | |
|---|---|---|
| aluminium sulphate, | $Al_2(SO_4)$ | (technical grade) |
| sodium silicate, | $Na_2SiO_3$ | (type 0) |
| sodium metabisulphite | $Na_2S_2O_5$ | (technical grade) |

Type 0 sodium silicate is otherwise known as waterglass. It is usually available as a very viscous solution containing about 9.16% by weight $Na_2O$, 29.5% by weight $SiO_2$, or in total 38.65 weight percent solids, the balance being water.

The selectivity enhancing agent is prepared by mixing the chemical compounds in a preferred ratio of $Al_2(SO_4)_3$:$Na_2SiO_3$:$Na_2S_2O_5$=2:3:2.

In premixing the agent the required amount of Type 0 sodium silicate or waterglass is diluted to a 5% solution with water and then added to the appropriate amount of aluminium sulphate with agitation. A hydrosol in an aqueous solution is usually obtained immediately after mixing, and the agitation is preferably maintained until the suspension is substantially eliminated. The third chemical component sodium metabisulphite is added in the appropriate amount at this stage and mixed with the solution already containing the aluminium sulphate and the diluted waterglass. The selectivity enhancing agent prepared is usually a somewhat turbid solution.

The agent is added between 300 to 800 g/ton depending on the nature of the ore. It may be added at more than one point in various stages of the beneficiation process.

The ratio of the chemical compounds in the premixed aqueous solution may be changed but best results are obtained when the agent is prepared in the above described ratio and observing the above conditions.

The application of the selectivity enhancing agent to the separation of copper in a massive sulphidic ore is described in the following examples. For the sake of simplicity the selectivity enhancing agent prepared as described is referred to in the examples as A3-3. It is generally understood that massive sulphidic ores contain over 50% sulphides.

The basic test procedures used in the examples are standard laboratory pilot plant and industrial plant procedures commonly employed in the mineral dressing practice for evaluation of different ore types. The massive sulphide ore is usually ground to liberation size with water and additions of conventional depressants, pH modifiers and collectors. Additions of selectivity enhancing agent A3-3 is made to either the grinding stage and/or the subsequent conditioning stage. The flotation of valuable minerals is carried out using standard equipment and methods.

EXAMPLE 1

A massive sulphide ore, originating in Spain and containing copper, zinc and silver as predominant value metals was treated in a flotation circuit using conventional reagents. The ore contained the usual gangue minerals as well as pyrite, which needed to be separated in the beneficiation process.

This ore is finely disseminated and hence requires grinding to a degree of fineness containing more than 85% of particle size less than 30 μm, to attain a desired degree of liberation.

In this example laboratory tests were conducted in continuous locked cycles; that is the intermediate products of the flotation stages were recycled in order to simulate commercial flotation plant flowsheets.

The beneficiation process included the following conventional flotation treatment steps.

(a) Grinding of the ore to obtain 85% less than 30 μm in the presence of lime as pH modifier, added at a rate of 300–800 g/ton, and sodium cyanide, NaCN for depressing zinc minerals and pyrite. The cyanide was added at 20–50 g/ton.

(b) The slurry of the ground ore was conditioned with $SO_2$ to depress pyrite at a rate of 500–700 g/ton. The copper was then recovered by adding an xanthate collector and frother, MIBC (methyl-iso-butyl carbinol). The xanthate collector used was A350, made and marketed by Cyanamid. The final copper sulphide concentrate obtained in this locked cycle flotation step, is referred to in the following tables as copper cleaner concentrate and is abbreviated as Cu Clean. Conc.

(c) The zinc sulphide mineral was recovered from the copper final tailing obtained in the copper flotation step (b) by the application of a conventional lime-$CuSO_4$ circuit. The zinc containing tailing was conditioned in the conventional manner with lime and copper sulphate addition. The zinc sulphide was then floated in the presence of conventional zinc collectors in a locked cycle flotation step. The final zinc concentrate obtained is indicated as Zn Clean. Conc. in the following tables.

The tailings obtained in the zinc roughing and first cleaning operations are shown as the zinc combined tailing (Zn Comb. Tail).

The composition of the ore is shown in the following tables as copper and zinc in weight percent and silver in g/ton in the feed mineral.

TABLE 1

| Ore | | Wt. | Assays | | | % Distribution | | |
|---|---|---|---|---|---|---|---|---|
| Type | Product | % | Cu % | Zn % | Ag g/ton | Cu | Zn | Ag |
| A | Cu Clean. Conc. | 1.83 | 24.2 | 6.22 | 250. | 85.1 | 18.40 | 52.1 |
| | Zn Clean. Conc. | 0.84 | 1.95 | 51.50 | 83.0 | 3.1 | 70.0 | 7.9 |
| | Zn Comb. Tail | 97.33 | 0.062 | 0.08 | 3.65 | 11.7 | 11.9 | 40.0 |
| | Head (Calc) | 100.0 | 0.52 | 0.62 | 8.83 | 100.0 | 100.0 | 100.0 |
| B | Cu Clean. Conc. | 6.75 | 22.1 | 6.15 | 280. | 84.8 | 16.2 | 58.0 |
| | Zn Clean. Conc. | 3.44 | 1.55 | 53.50 | 55.0 | 3.0 | 75.1 | 5.8 |
| | Zn Comb. Tail | 89.81 | 0.24 | 0.24 | 13.1 | 12.2 | 8.7 | 36.2 |
| | Head (Calc) | 100.0 | 1.76 | 2.45 | 32.6 | 100.0 | 100.0 | 100.0 |

EXAMPLE 2

Laboratory locked cycle flotation tests were carried out in steps as described in Example 1, but with additions of selectivity enhancing agent A3-3. The agent A3-3 was added to the grind at a rate of 300 g/ton and to the copper cleaning stages. The results of the flotation tests obtained with the selectivity enhancing agent are shown in Table 2.

TABLE 2

| Ore | | Wt. | Assays | | | % Distribution | | |
|---|---|---|---|---|---|---|---|---|
| Type | Product | % | Cu % | Zn % | Ag g/ton | Cu | Zn | Ag |
| A | Cu Clean. Conc. | 1.73 | 26.89 | 4.16 | 278.0 | 89.6 | 11.5 | 54.0 |
| | Zn Clean. Conc. | 0.86 | 1.43 | 52.52 | 82.8 | 2.4 | 72.2 | 8.1 |
| | Zn Comb. Tail | 97.41 | 0.043 | 0.105 | 3.4 | 8.0 | 16.3 | 37.5 |
| | Head (Calc) | 100.0 | 0.52 | 0.62 | 8.83 | 100.0 | 100.0 | 100.0 |
| B | Cu Clean. Conc. | 6.13 | 26.10 | 5.11 | 305. | 90.0 | 12.8 | 57.3 |
| | Zn Clean. Conc. | 3.42 | 0.72 | 55.31 | 55.1 | 1.4 | 77.2 | 5.8 |
| | Zn Comb. Tail | 90.45 | 0.15 | 0.27 | 13.3 | 7.7 | 10.0 | 36.9 |
| | Head (Calc) | 100.0 | 1.76 | 2.45 | 32.6 | 100.0 | 100.0 | 100.0 |

It can be seen by comparing the flotation test results in Tables 1 and 2 that the addition of the selectivity enhancing agent of this invention has significantly improved the copper concentrate grade and the copper recovery from the ore. The selectivity between copper and zinc has also been improved.

EXAMPLE 3

A massive sulphide ore from Northern Ontario (Canada) containing 0.5–0.9% copper, 2.0–3.0% zinc and 2–3.5 g/ton gold which were finely disseminated in the pyrite present in the ore. The pyrite contained in this ore was in excess of 90%. This ore was subjected to to a sequential copper sulphide, zinc flotation procedure using conventional treatment steps and the following commercially available reagents at the indicated rate:

| | | |
|---|---|---|
| Grind | 95% < 40 μm | |
| Copper Circuit: | pH modifier: | $Ca(OH)_2$ = 800 g/ton |
| | Depressant: | $SO_2$ = 700 g/ton |
| | Collectors: | Aeroflot (R208)* = 15 g/ton |
| | | Xanthate (A350)* = 10–15 g/ton |
| | Frother: | MIBC = 10–15 g/ton |
| Zinc Circuit: | pH modifier | $Ca(OH)_2$ = 1500 g/ton |
| | Activator: | $CuSO_4$ = 450 g/ton |
| | Collector: | Xanthate (A343)* = 20 g/ton |
| | Frother: | DF 250** = 10 g/ton |

*Marketed by Cyanamid Company
**Marketed by Dow Chemical Company

The results obtained in the continuous laboratory locked cycle tests are shown in Table 3.

TABLE 3

| Product | Wt. % | Assays Cu % | Zn % | Au g/ton | Ag g/ton | % Distribution Cu | Zn | Au | Ag |
|---|---|---|---|---|---|---|---|---|---|
| Cu Clean. Conc. | 2.83 | 20.1 | 3.43 | 85.1 | 143. | 62.8 | 4.7 | 55.4 | 12.4 |
| Zn Clean. Conc. | 3.22 | 1.72 | 54.0 | 1.75 | 123.1 | 6.1 | 83.6 | 1.3 | 12.1 |
| Zn Comb. Tail | 93.95 | 0.30 | 0.26 | 2.00 | 26.3 | 31.1 | 11.7 | 43.3 | 75.5 |
| Head (Calc) | 100.0 | 0.91 | 2.08 | 4.34 | 32.7 | 100. | 100.0 | 100.0 | 100.0 |

Ore Type: Northern Ontario Ore

EXAMPLE 4

The ore of Example 4 was treated in the same manner as is described in Example 3, but with selectivity enhancing agent A3-3 added at a rate of 300 g/ton to the grind and at 100 g/ton to the copper cleaners. The results obtained are shown in Table 4.

TABLE 4

| Product | Wt. % | Assays Cu % | Zn % | Au g/ton | Ag g/ton | % Distribution Cu | Zn | Au | Ag |
|---|---|---|---|---|---|---|---|---|---|
| Cu Clean. Conc. | 3.21 | 23.05 | 3.87 | 70.0 | 235. | 81.0 | 6.1 | 58.2 | 22.9 |
| Zn Clean. Conc. | 3.29 | 1.02 | 54.1 | 1.6 | 94. | 4.7 | 85.7 | 1.4 | 9.4 |
| Zn Comb. Tail | 93.50 | 0.15 | 0.18 | 1.67 | 23.8 | 15.3 | 8.2 | 40.4 | 67.7 |
| Head (Calc) | 100.0 | 0.91 | 2.04 | 3.86 | 32.9 | 100. | 100.0 | 100.0 | 100.0 |

Ore Type: Northern Ontario Ore

As can be seen in the results tabulated in Tables 3 and 4 the use of selectivity enhancing agent A3-3 improved the copper grade and copper recovery from 62.6% copper recovery in the absence of the selectivity enhancing agent, to 81% copper recovery in the presence of A3-3. There were notable improvements in the zinc and silver recoveries as well.

EXAMPLE 5

The ore or Examples 3 and 4 was treated in a continuous pilot plant operation at a rate of 150 kilograms per hour. The conditions and reagents used in the pilot plant scale continuous test were similar to those of Example 4 and with similar additions of selectivity enhancing agent A3-3. These results are shown in Table 5.

TABLE 5

| Product | Wt. % | Assays Cu % | Zn % | Au g/ton | Ag g/ton | % Distribution Cu | Zn | Au | Ag |
|---|---|---|---|---|---|---|---|---|---|
| Cu Clean. Conc. | 1.86 | 23.8 | 1.49 | 50.9 | 252. | 70.0 | 0.9 | 42.8 | 16.2 |
| Zn Clean. Conc. | 5.13 | 0.92 | 53.9 | 1.3 | 72. | 7.6 | 88.7 | 3.3 | 12.8 |
| Zn Comb. Tail | 93.01 | 0.16 | 0.35 | 1.48 | 22.8 | 22.4 | 10.4 | 53.9 | 71.0 |
| Head (Calc) | 100.0 | 0.63 | 3.12 | 2.85 | 29.8 | 100. | 100.0 | 100.0 | 100.0 |

Ore Type: Northern Ontario Ore

The results obtained in the laboratory batch continuous test of Example 4 were confirmed in the continuous pilot plant test as shown in Table 5.

EXAMPLE 6

The massive sulphide ore from Northern Ontario (Canada) was treated in an industrial scale plant at Lake Dufault mill. The ore was ground somewhat coarser than in Examples 3, 4 and 5, but the same reagents as described in Example 3 were used. The results obtained using conventional reagents only are shown in Table 6, and results obtained using conventional reagents together with the selectivity enhancing agent A3-3 added as described in Example 4 are shown in Table 7.

TABLE 6

| Product | Wt. % | Assays Cu % | Zn % | Au g/ton | Ag g/ton | % Distribution Cu | Zn | Au | Ag |
|---|---|---|---|---|---|---|---|---|---|
| Cu Clean. Conc. | 1.75 | 20.2 | 3.30 | 60.84 | 368.5 | 56.0 | 2.1 | 45.5 | 21.5 |
| Zn Clean. Conc. | 4.27 | 0.40 | 50.8 | 1.5 | 75. | 2.7 | 78.0 | 2.7 | 10.7 |
| Zn Comb. Tail | 93.98 | 0.28 | 0.58 | 1.29 | 21.65 | 41.3 | 19.9 | 51.8 | 67.8 |

TABLE 6-continued

| Product | Wt. % | Assays Cu % | Zn % | Au g/ton | Ag g/ton | % Distribution Cu | Zn | Au | Ag |
|---|---|---|---|---|---|---|---|---|---|
| Head (Calc) | 100.0 | 0.63 | 2.78 | 2.34 | 30.0 | 100. | 100.0 | 100.0 | 100.0 |

Ore Type: Northern Ontario Ore

TABLE 7

| Product | Wt. % | Assays Cu % | Zn % | Au g/ton | Ag g/ton | % Distribution Cu | Zn | Au | Ag |
|---|---|---|---|---|---|---|---|---|---|
| Cu Clean. Conc. | 2.14 | 23.3 | 4.18 | 49.96 | 303.2 | 72.2 | 3.1 | 48.6 | 22.0 |
| Zn Clean. Conc. | 4.52 | 0.40 | 52.0 | 1.61 | 76.3 | 2.6 | 83.0 | 3.3 | 11.7 |
| Zn Comb. Tail | 93.34 | 0.18 | 0.42 | 1.13 | 20.9 | 25.2 | 13.9 | 48.1 | 66.3 |
| Head (Calc) | 100.0 | 0.69 | 2.83 | 2.20 | 29.5 | 100. | 100.0 | 100.0 | 100.0 |

Ore Type: Northern Ontario Ore

Tables 2, 4, 5 and 7 show that the selectivity enhancing agent A3-3 improved the grade and recovery of the copper concentrate sigificantly compared to using the conventional reagents only. The recovery of zinc was also increased. It can thus be seen that the selectivity enhancing agent of the present invention notably improves the selectivity of the ore beneficiation process.

The lead present in the ores treated for recovery in the examples may be recovered from the combined tailings if desired.

It should be obvious to those skilled in the art that other value metals if present in the ore may also be recovered from the tailing at any stage of the beneficiation process.

It is also clearly inidicated that the selectivity enhancing agent described above reduces the flotability of the sulphide gangue minerals, such as pyrite, pyrrhotite and marcasite.

The selectivity enhancing agent of this invention is particularly effective for treatment of finely disseminated ores where a fine grind is required for liberation and economical recovery of valuable minerals.

Although the present invention has been described with reference to the preferred embodiment, it is to be understood that modifications and variations may be resorted to without departing from the spirit and scope of the invention as those skilled in the art will readily understand. Such modifications and variations are considered to be within the purview and scope of the invention and appended claims.

I claim:

1. A method for enhancing the selectivity of a collector agent used in froth flotation for attaining mineral separation in a copper sulphidic mineral bearing ore beneficiation process comprising, adding a premixed aqueous solution containing a water soluble polyvalent metal sulphate, and an alkali metal silicate and an alkali metal metabisulphite to an aqueous slurry of the copper sulphidic mineral bearing ore in a stage preceding froth flotation, said froth flotation being conducted in the presence of said collector agents, to obtain a separated ore phase enriched in said copper minerals, and a flotation tailing.

2. A method according to claim 1 wherein the ratio of the reagents contained in the premixed aqueous solution comprises, polyvalent metal sulphate:alkali metal silicate:alkali metal metabisulphite=$2\pm0.3:3\pm0.4:2\pm0.3$.

3. A method according to claim 1 or 2 wherein the polyvalent metal sulphate is aluminum sulphate.

4. A method according to claim 1 or 2 wherein the alkali metal is at least one of the group: sodium and potassium.

5. A method according to claim 1 or 2 wherein the alkali metal silicate is waterglass.

6. A method according to claim 1 or 2, wherein the preparation of the premixed aqueous solution includes a first mixing step of a polyvalent metal sulphate with an alkali metal silicate solution, and a subsequent second mixing of an alkali metal metabisulphite into said first solution.

7. A method according to claim 1 wherein the copper mineral bearing ore also contains zinc bearing minerals which are depressed in the flotation tailing in said flotation separation step, and the separation of said zinc bearing minerals by a subsequent zinc bearing mineral flotation step is also enhanced by said premixed aqueous solution.

8. A method according to claim 1, 2 or 7 wherein said copper mineral bearing ore also contains one of the group: silver and gold, and the separation of said silver and gold is also enhanced by the addition of said premixed aqueous solution.

9. A method according to claim 1, wherein the copper mineral bearing ore also contains lead bearing minerals which are depressed in the flotation tailing in said flotation separation step, and said lead bearing minerals in said tailing are separated by a subsequent lead beneficiation process step.

10. A method according to claim 1 or 2 wherein said premixed aqueous solution is added to a wet grinding step in said ore beneficiation process.

11. A method according to claim 1 or 2 wherein said premixed aqueous solution is added to an ore slurry conditioned to be subsequently subjected to froth flotation in said ore beneficiation process.

* * * * *